US008453356B2

(12) United States Patent
Mian

(10) Patent No.: US 8,453,356 B2
(45) Date of Patent: Jun. 4, 2013

(54) FOOTWEAR

(76) Inventor: Omar Mian, Birmingham (GB)

( * ) Notice: Subject to any disclaimer, the term of this patent is extended or adjusted under 35 U.S.C. 154(b) by 389 days.

(21) Appl. No.: 12/740,378

(22) PCT Filed: Oct. 1, 2008

(86) PCT No.: PCT/GB2008/003339

§ 371 (c)(1),
(2), (4) Date: Jul. 8, 2010

(87) PCT Pub. No.: WO2009/056789

PCT Pub. Date: May 7, 2009

(65) Prior Publication Data

US 2010/0275464 A1 Nov. 4, 2010

(30) Foreign Application Priority Data

Oct. 29, 2007 (GB) ..... 0721193.1

(51) Int. Cl.
*A43B 23/00* (2006.01)

(52) U.S. Cl.
USPC ..... 36/136; 2/69

(58) Field of Classification Search
USPC ..... 36/136; 24/303; 2/69, 244
See application file for complete search history.

(56) References Cited

U.S. PATENT DOCUMENTS

| | | | | |
|---|---|---|---|---|
| 5,673,501 | A | 10/1997 | Mathews | |
| 6,115,948 | A * | 9/2000 | Mitchell | 36/136 |
| 6,769,204 | B1 * | 8/2004 | Phillips | 36/136 |
| 6,829,847 | B2 * | 12/2004 | O'Shea et al. | 36/70 R |
| 7,444,768 | B2 * | 11/2008 | Friton | 36/50.1 |
| 7,843,297 | B2 * | 11/2010 | Fullerton et al. | 335/306 |
| 2003/0101625 | A1 * | 6/2003 | Wu | 36/136 |
| 2004/0049948 | A1 * | 3/2004 | O'Shea et al. | 36/70 R |
| 2004/0093765 | A1 | 5/2004 | Baldwin | |
| 2005/0178026 | A1 * | 8/2005 | Friton | 36/50.1 |
| 2005/0198788 | A1 | 9/2005 | Costa | |
| 2006/0282993 | A1 * | 12/2006 | Dietz | 24/303 |
| 2007/0130802 | A1 * | 6/2007 | Condie | 36/101 |
| 2007/0151084 | A1 | 7/2007 | Long | |
| 2008/0022558 | A1 * | 1/2008 | Kaufer | 36/100 |
| 2010/0122474 | A1 * | 5/2010 | Wolf et al. | 36/101 |
| 2012/0180197 | A1 * | 7/2012 | Cosky | 2/338 |

FOREIGN PATENT DOCUMENTS

| | | |
|---|---|---|
| GB | 2410672 | 8/2005 |
| GB | 2426426 | 11/2006 |
| WO | WO 2005/074738 | 8/2005 |
| WO | WO 2006/017089 | 2/2006 |

OTHER PUBLICATIONS

European Patent Office (as ISA), International Search Report, PCT/GB2008/003339, dated May 20, 2009.
European Patent Office (as ISA), Written Opinion, PCT/GB2008/003339, dated May 20, 2009.

* cited by examiner

*Primary Examiner* — Marie Patterson
(74) *Attorney, Agent, or Firm* — Ice Miller LLP

(57) ABSTRACT

The present application relates to an accessory item for temporary manual attachment to, and temporary manual removal from, an item of footwear, the accessory item comprising a first magnetic material part and a second magnetic material part, the first magnetic material part and the second magnetic material part are arranged to temporary attach to a magnetic material part on an item of footwear, wherein the first magnetic material part is spaced from the second magnetic material part.

20 Claims, 6 Drawing Sheets

FOOTWEAR

PRIORITY

The present application is related to, and claims the priority benefit of, International Patent Application Serial No, PCT/GB2008/003339, filed Oct. 1, 2008, which is related to, and claims the priority benefit of, Great Britain Patent Application Serial No. 0721193.1, filed Oct. 29, 2007. The contents of each of these applications are hereby incorporated by reference in their entirety into this disclosure.

The invention relates to improvements to footwear.

People like to have shoes of a different appearance for different occasions.

It is known from GB 2410672 A to provide a single shoe with multiple accessories of different appearance, each of which are readily attachable to the shoe and removable from the shoe to create a shoe of a different appearance.

GB 2410672 A discloses a base shoe 1 with a magnetic button 2 fixed, for example riveted, to the external surface of the shoe upper (see the abstract and the description relating to FIG. 1).

GB 2410672 A also discloses riveting two magnets to the external surface of the shoe upper and attaching a first accessory to the first magnet and a second accessory to the second magnet (see the abstract and the description relating to FIG. 3).

According to a first aspect of the invention there is provided an accessory item for temporary manual attachment to, and temporary manual removal from, an item of footwear, the accessory item comprising a first magnetic material part and a second magnetic material part, the first magnetic material part and the second magnetic material part are arranged to allow temporary attachment to a magnetic material part on an item of footwear, wherein the first magnetic material part is spaced from the second magnetic material part by a non-magnetic material.

The term "magnetic material part" means a magnet or a material which is attracted to a magnet.

One or more of the magnetic material parts may comprise a flat sheet. One or more of the magnetic material parts may be cylindrical. One or more of the magnetic material parts may be of circular cross section. One or more of the magnetic material parts may be less than 15 mm in diameter, preferably less than 10 mm diameter, and more than 3 mm diameter, and may optimally be in the range of 6-15 mm, preferably about 8 mm. One or more of the magnetic material parts may be less than 5 mm thick, and greater than 0.5 mm thick, and may optimally be in the range of about 0.75 to 2.5 mm thick, preferably about 0.9 mm.

The first magnetic material part on the accessory and the second magnetic material part on the accessory may be spaced apart by between about 5 cm and 8 cm or by between about 10 cm and 16 cm, corresponding to about half the distance across the width of the toe of the shoe and the distance across the width of the top of the shoe, respectively. The accessory may comprise a third magnetic material part. The first magnetic material part may be spaced from the second magnetic material part by between about 5 cm and 8 cm, and the second magnetic material part may be spaced from the third magnetic material part by between about 5 cm and 8 cm. The first, second and third magnetic material parts may be arranged in a straight line, or close thereto.

The accessory item may comprise a piece of material, and the first magnetic material part and the second magnetic material part may be arranged on the same piece of material.

According to a second aspect of the invention there is provided an item of footwear arranged to receive an accessory item which can be manually attached and removed, the item of footwear comprising an upper foot retaining part, a first magnetic material part and a second magnetic material part, the first magnetic material part being arranged on a first side of the upper foot retaining part at the front of the shoe, the second magnetic material part being arranged on a second side of the upper foot retaining part at the front of the shoe opposite to the first side, or on the centre of the upper foot retaining part at the front of the shoe, to allow temporary manual attachment of, and temporary manual removal of, an accessory item.

The item of footwear may comprise a third magnetic material part. The first magnetic material part may be arranged on a first side of the upper at the front of the shoe, the second magnetic material part may be arranged on the centre of the upper at the front of the shoe, and the third magnetic material part may be arranged on a second side of the shoe.

The first magnetic material part may be spaced from the second magnetic material part by between about 5 cm and 8 cm, and the second magnetic material part may be spaced from the third magnetic material part by between about 5 cm and 8 cm. The first, second and third magnetic material parts may be arranged in a straight line, or close thereto.

According to a third aspect of the invention there is provided an item of footwear arranged to receive an accessory item which can be manually attached and removed, the item of footwear comprising an upper foot retaining part, and a first magnetic material part and a second magnetic material part, both arranged on the upper foot retaining part, in a way that the upper foot retaining part alone connects and spaces the first and second magnetic material parts.

The upper foot retaining part may be a band across the front toe region or a band across the heel region.

According to a fourth aspect of the invention there is provided an item of footwear comprising an accessory in accordance with the first aspect temporarily attached thereto.

The item of footwear may comprise a first magnetic material part and a second magnetic material part. The first magnetic material part and the second magnetic material part of the item of footwear may positionally correspond with, respectively, the first magnetic material part of the accessory and the second magnetic material part of the accessory. The item of footwear may comprise a third magnetic material part. The first, second and third magnetic material parts of the item of footwear may positionally correspond with, respectively, the first, second and third magnetic material parts of the accessory.

According to a fifth aspect of the invention there is provided an item of footwear in accordance with the second aspect of the invention or the third aspect of the invention comprising an accessory temporarily attached thereto.

According to a sixth aspect of the invention there is provided an item of footwear in accordance with the second aspect of the invention or the third aspect of the invention comprising an accessory in accordance with the first aspect temporarily attached thereto.

According to a seventh aspect of the invention there is provided an accessory item for temporary manual attachment to an item of footwear, the accessory item comprising a foot holding part which is arranged to enclose part of a foot, wherein the accessory item also comprises a magnetic material part arranged to allow temporary manual attachment of the foot holding part to a magnetic material part on an item of footwear.

The foot holding part may comprise a first piece of material and a second piece of material, connectable by a buckle or the like.

According to an eighth aspect of the invention there is provided an item of footwear and an accessory, the accessory being arranged to connect two upper foot retaining parts of the item of footwear.

According to a ninth aspect of the invention there is provided an item of footwear and the accessory item of the seventh aspect of the invention fitted thereto.

The item of footwear comprises an upper. The magnetic material part of the foot holding part may attach to the front part of the upper of the item of footwear in the region of the toes. The foot holding part may extend from the magnetic material part on the foremost part of the item of footwear towards the back of the item of footwear. The piece of material may be arranged to enclose the ankle of the user.

GB 2410672 A, terminated before grant, in particular Claim 15, discloses that a magnetic button may be positioned "underneath base shoe". That term would normally be understood as meaning on or under the sole of the shoe. Also, where Claim 15 refers to a magnetic button that can be positioned "underneath base shoe", it refers to magnetic button 4. Since magnetic button 4 is used in conjunction with accessory part 5, and since the accessory is unlikely to be positioned inside the shoe, it seems to mean that the magnetic button is positioned under the sole of the shoe. It might for example be positioned on the raised underside between the heel and the toe. Therefore, although it seems slightly illogical, the statement "underneath base shoe" in GB 2410672 A arguably does not clearly and unambiguously disclose a magnet attached to, and hidden by, a top surface of the shoe. However, such a design may have practical limitations, for example a requirement for a stronger, and therefore costlier, magnet.

According to a tenth aspect of the invention there is provided an item of footwear comprising a magnetic material part hidden beneath the external surface of an upper part of the item of footwear so that an accessory item can be temporarily manually attached thereto and removed therefrom.

Preferably the aforementioned magnetic material parts are neodymium point magnets. Neodymium point magnets have not previously been used in clothing applications due to their high cost. They exert extremely high forces for their size, being able to support a mass in the order of 0.4 to 3.8 Kg, preferably 1 Kg, and are resistant to demagnetisation.

The magnetic parts may be arranged in an asymmetric configuration with respect to the footwear and/or accessory. For example the magnetic parts may be positioned at different distances from a notional centerline of the footwear and/or accessory.

Where three or more magnetic parts are provided on the footwear and/or accessory, the magnetic parts may be arranged in an asymmetric pattern.

Where two or more magnetic parts are provided on the footwear and/or accessory, the magnetic parts may be oriented with their polarities in an asymmetric configuration. For example a first magnetic part may be oriented with its North pole facing generally outwards from the footwear, whereas a second magnetic part may have its South pole facing generally outwards from the footwear.

Similarly an item of footwear may be provided with a detachable accessory, the accessory having a first region for attachment to a first part of the item of footwear and a second region for attachment to a second part of the item of footwear in which the first region and the first part comprise corresponding magnetic parts, and the second region and the second part comprise corresponding magnetic parts, wherein the magnetic parts on the first region and the second region facing the first part and the second part are opposite in polarity.

Asymmetric configuration of the pattern (i.e. placement) or polarity of the magnetic parts prevents incorrect positioning of the accessory relative to the item of footwear. This is particularly helpful to those who may have poor sight, or poor manual dexterity as the accessory will naturally tend to the correct orientation.

By asymmetric we mean having no symmetry about any plane.

An item of footwear may be provided with a detachable accessory, the accessory having a first arrangement of a plurality of magnetic parts, the item of footwear having a second mirror-image arrangement of a plurality of magnetic parts, in which the first arrangement and the second arrangement are configured such that with all of the magnetic parts of the first arrangement and the second arrangement mating respectively only one orientation of the accessory relative to the item of footwear is possible.

The accessory and/or footwear may be provided with a fourth magnetic part. Higher numbers of magnetic parts are envisaged.

The accessory may be functional (e.g. a strap or buckle) or aesthetic (e.g. a bow, ribbon jewelry or the like).

Any of the preceding features may be combined.

A shoe and accessories in accordance with the invention will now be described, by way of example only and with reference to the accompanying drawings, in which.

Figure 1:
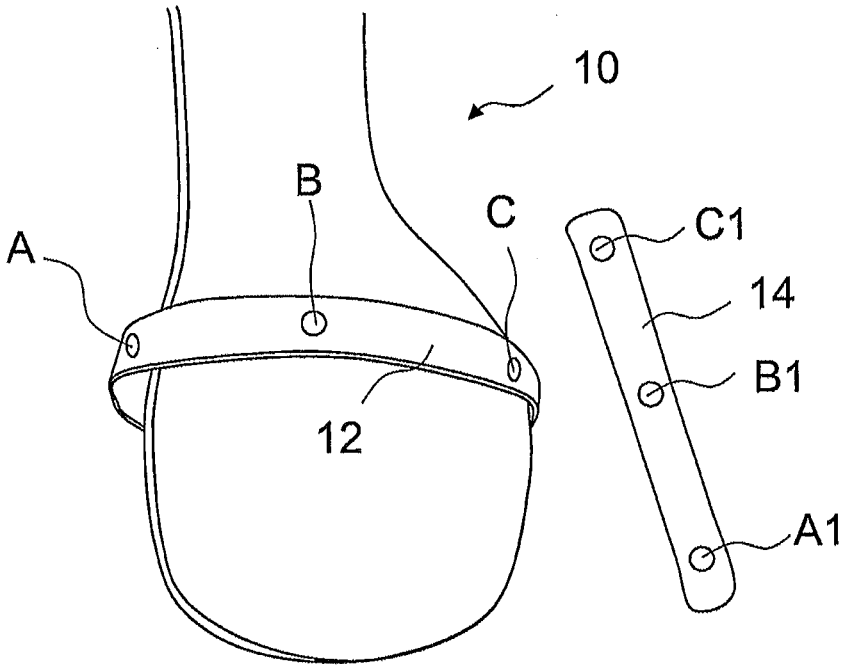
FIG. 1 shows an upper part of a shoe with a plurality of point magnets, and a first accessory, with a plurality or corresponding point magnets.

Referring to FIG. 1, a shoe 10 comprises three neodymium point magnets, A, B and C positioned on a strap 12 of the shoe.

Still referring to FIG. 1, corresponding opposite polarity point magnets A1, B1 and C1 are attached to a detachable accessory item 14.

Figure 2:
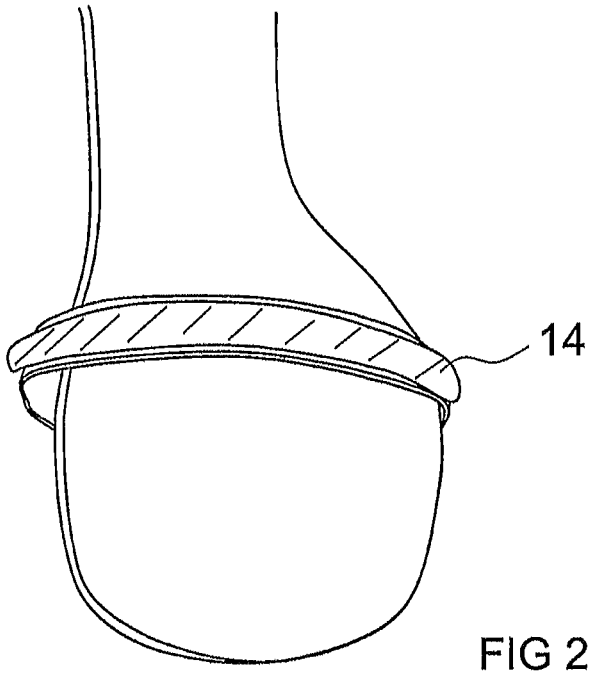
FIG. 2 shows the accessory of FIG. 1 fitted to the shoe.

The accessory item 14 can be fitted to the shoe via the corresponding magnets A and A1, B and B1, C and C1, to create a 'new look' shoe as shown in FIG. 2.

Figure 3:
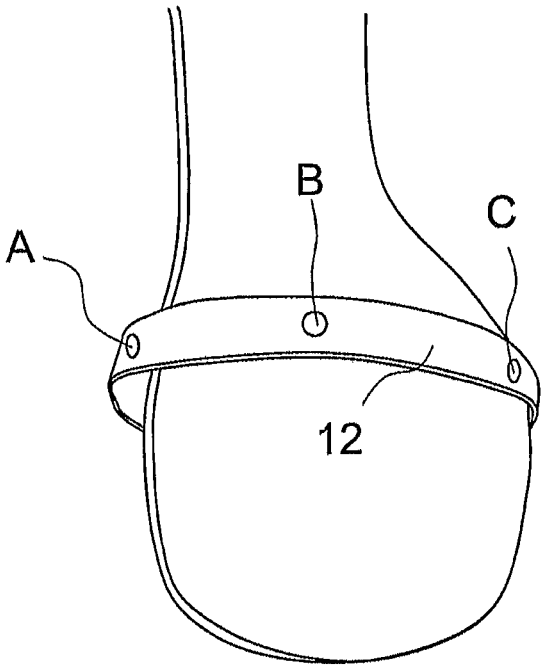
FIG. 3 shows an upper part of another shoe with a plurality of point magnets.
Figure 4:
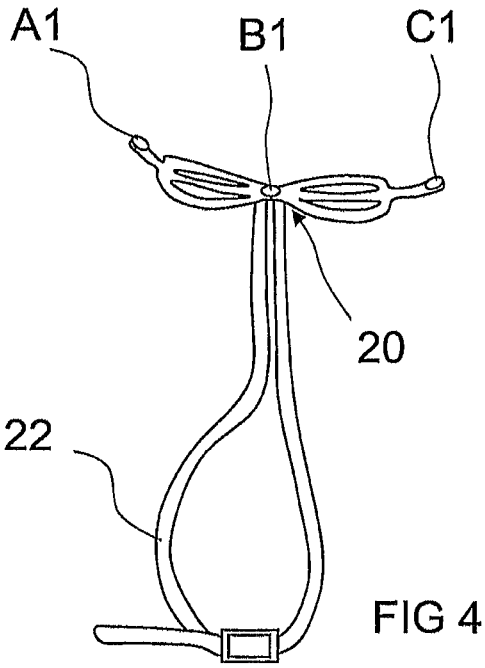
FIG. 4 shows the shoe of FIG. 3 and a second accessory with a plurality of corresponding point magnets.
Figure 5:
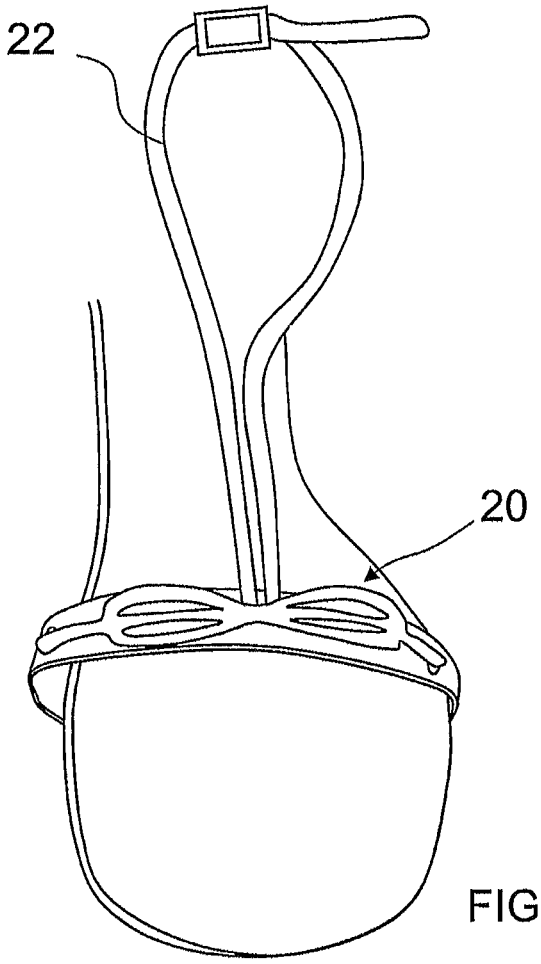
FIG. 5 shows the second accessory fitted to the shoe of FIG. 3.

Referring to FIGS. 3 to 5, an accessory item 20 comprises a foot holding part 22.

Figure 6:
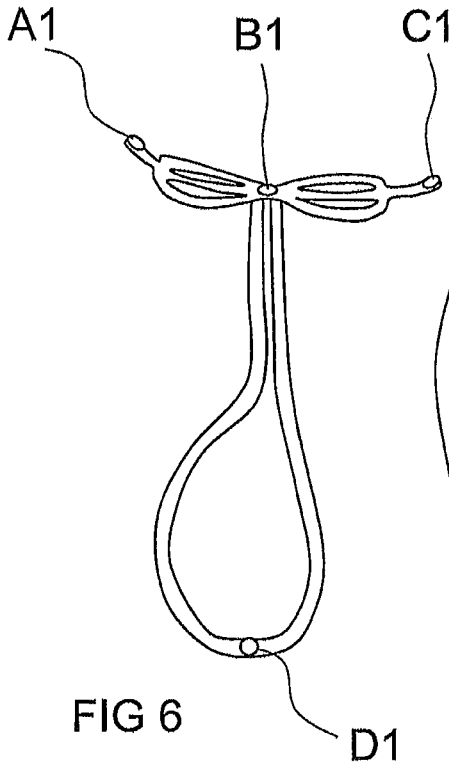
Figure 7:
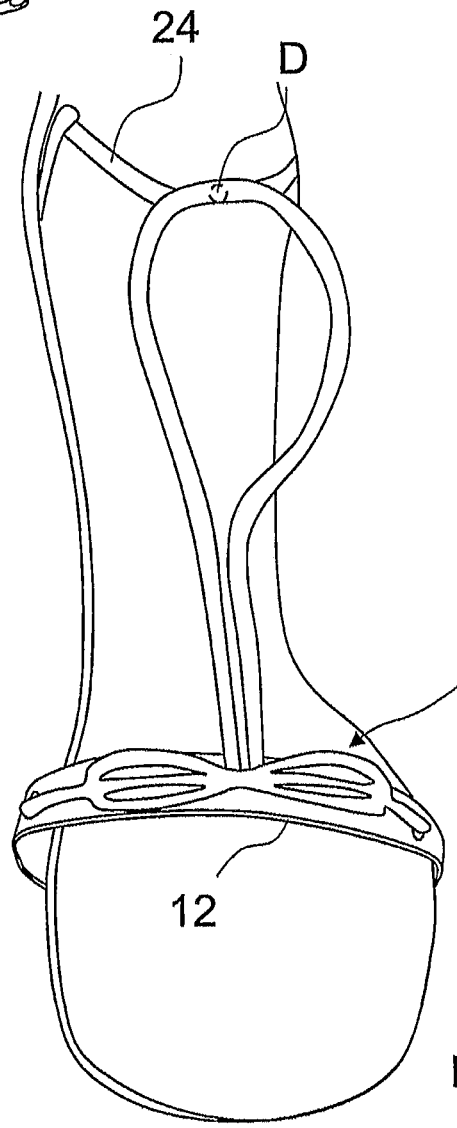

Referring to FIGS. 6 and 7, the holding part 22 comprises a further magnet, D. A further strap 24 of the shoe comprises a fourth magnet D. A corresponding magnet D1 is provided on the accessory. The accessory is able to span the straps 12, 24.

Figure 8:
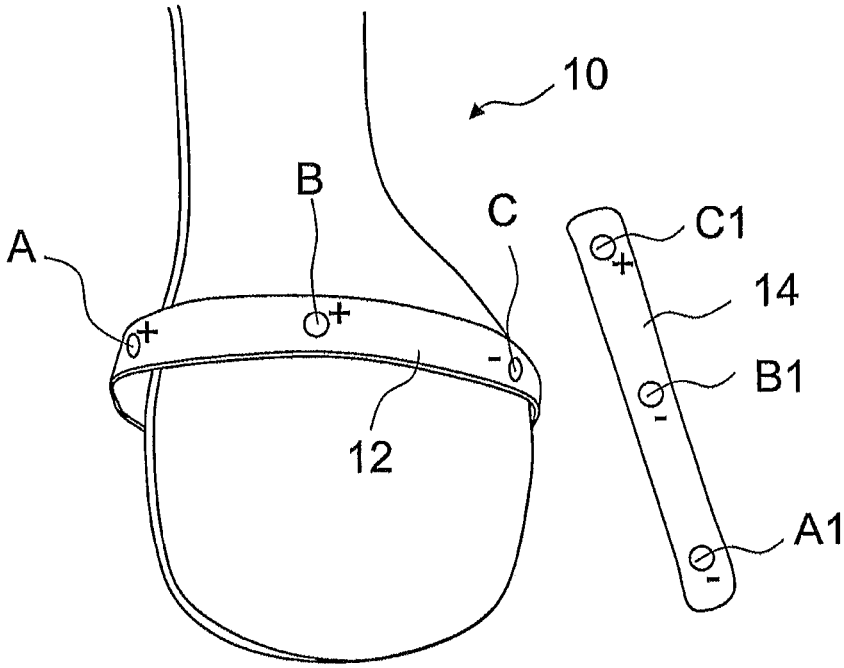

Referring to FIG. 8, the strap 12 of the shoe 10 comprises two magnets A, B with a positive polarity facing outward from the shoe. A third magnet C has a negative polarity facing outward from the shoe.

The accessory 14 has a corresponding arrangement of polarities, with magnets A1 and B1 negative and magnet C1 positive. As such efforts to attach the accessory the wrong way round will result in magnets A & C1 and C and A1 repelling.

Figure 9:
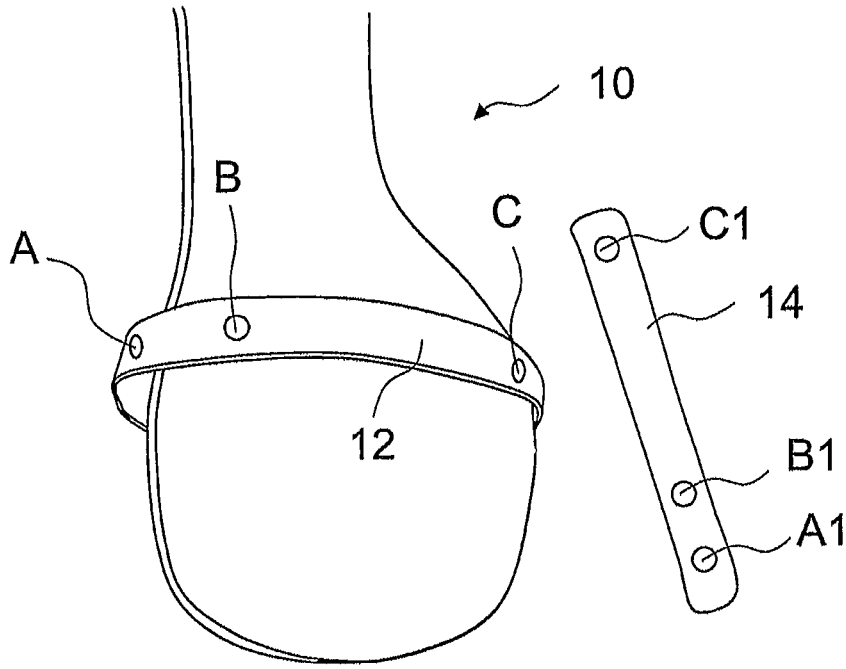
Figure 10:
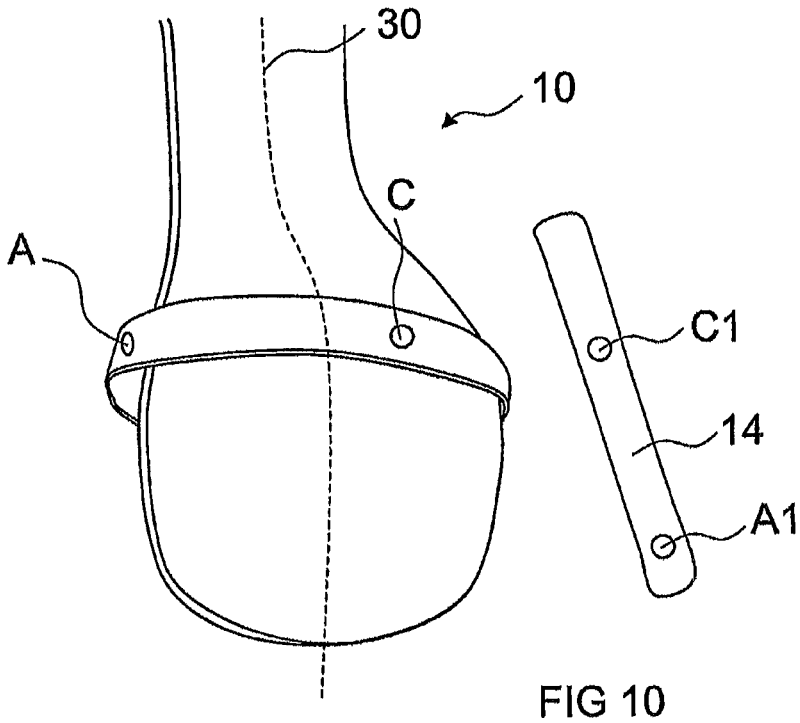

Referring to FIG. 9, the magnets A, B, C are arranged in an asymmetric pattern. The corresponding magnets on the accessory A1, B1, C1 are also arranged in a corresponding (mirror image) asymmetric pattern. Therefore the magnets serve as both a visual indicator to which the accessory should be attached, and incorrect attachment will result in magnets B and B1 not mating.

Finally, with respect to FIG. 9 a notional shoe centreline 30 is shown. The two magnets A, B are arranged asymmetrically about the centreline 30. The corresponding magnets A1, B1 on the strap are also arranged in the same pattern such that if the accessory 14 is attached the wrong way around, it will protrude excessively from the side of the shoe 12 indicating that the orientation is incorrect.

There are many advantages of the invention.

Design, colour and look of the shoe can be changed.

One shoe can complement different outfits.

Fashion accessorise.

Change the shoe look during the course of an event (e.g. reception, wedding, disco).

Multi-coloured designer outfits can be easily accessorised.

Comfortable shoes can be worn and still be 'in fashion'.

Point magnets are discrete and may be embedded into the material or placed in a visible position.

Reduces cost.

The invention claimed is:

1. An accessory item for temporary manual attachment to, and temporary manual removal from, an item of footwear, the accessory item comprising a first magnetic material part, a second magnetic material part and a third magnetic material part, the first magnetic material part, the second magnetic material part and the third magnetic material part are arranged to allow temporary attachment to a magnetic material part on an item of footwear, wherein the first, second and third magnetic material parts are spaced from each other by a non-magnetic material and the first magnetic material part, the second magnetic material part and the third magnetic material part are arranged in an asymmetric configuration, wherein the asymmetric configuration comprises an asymmetric configuration of magnet polarities.

2. An accessory item according to claim 1 in which the asymmetric configuration comprises an asymmetric spatial arrangement of the magnetic material parts.

3. An accessory item according to claim 1, wherein the first magnetic material part is spaced from the second magnetic material part by between about 5 cm and 8 cm.

4. An accessory item according to claim 1, wherein the second magnetic material part is spaced from the third magnetic material part by between about 5 cm and 8 cm.

5. An accessory item according to claim 1, wherein the first, second and third magnetic material parts are arranged in a straight line, or close thereto.

6. An accessory item according to claim 1 comprising a fourth magnetic part.

7. An accessory item according to claim 1, wherein one or more of the magnetic material parts comprises one or more of the following:

a flat sheet;

a cylinder;

a circular cross section having a diameter less than 15 mm; and a thickness less than 5 mm.

8. An accessory item according to claim 1, wherein the accessory item comprises a decorative material, and at least one or each of the magnetic material parts are arranged so that they can be hidden by the decorative material.

9. An item of footwear arranged to receive an accessory item which can be manually attached and removed, the item of footwear comprising an upper foot retaining part, a first magnetic material part and a second magnetic material part, the first magnetic material part being arranged on a first side of the upper foot retaining part at the front of the shoe, the second magnetic material part being arranged on a second side of the upper foot retaining part at the front of the shoe opposite to the first side, or on the centre of the upper at the front of the shoe, to allow temporary manual attachment of, and temporary manual removal of, an accessory item and the first magnetic material part and the second magnetic material part are arranged in an asymmetric configuration, wherein the asymmetric configuration comprises an asymmetric configuration of magnet polarities.

10. An item of footwear according to claim 9 in which the asymmetric configuration comprises an asymmetric spatial arrangement of the magnetic material parts.

11. An item of footwear according to claim 9, wherein the item of footwear comprises a third magnetic material part.

12. An item of footwear according to claim 11, wherein the first magnetic material part is arranged on a first side of the upper at the front of the shoe, the second magnetic material part is arranged on the centre of the upper at the front of the shoe, and the third magnetic material part is arranged on a second side of the shoe.

13. An item of footwear according to claim 9, wherein the first magnetic material part is spaced from the second magnetic material part by between about 5 cm and 8 cm.

14. An item of footwear according to claim 11, wherein the second magnetic material part is spaced from the third magnetic material part by between about 5 cm and 8 cm.

15. An item of footwear according to claim 11, wherein the first, second and third magnetic material parts are arranged in a straight line, or close thereto.

16. An item of footwear arranged to receive an accessory item which can be manually attached and removed, the item of footwear comprising an upper foot retaining part, and a first magnetic material part, a second magnetic material part, and a third magnetic material part arranged on the upper foot retaining part, in a way that the upper foot retaining part alone connects and spaces the first, second, and third magnetic material parts, in which the first magnetic material part, the second magnetic material part, and the third magnetic material part are arranged in an asymmetric configuration wherein the asymmetric configuration comprises an asymmetric configuration of magnet polarities.

17. An item of footwear comprising an accessory item temporarily attached thereto, the accessory item comprising a first magnetic material part and a second magnetic material part, the first magnetic material part and the second magnetic material part are arranged to allow temporary attachment to a magnetic material part on the item of footwear, wherein the first magnetic material part is spaced from the second magnetic material part by a non-magnetic material and the first magnetic material part and the second magnetic material part are arranged in an asymmetric configuration, wherein the asymmetric configuration comprises an asymmetric configuration of magnet polarities.

18. An item of footwear according to claim 17, wherein the item of footwear comprises a first magnetic material part and a second magnetic material part, and the first magnetic material part and the second magnetic material part of the item of footwear positionally correspond with, respectively, the first magnetic material part of the accessory and the second magnetic material part of the accessory.

19. An item of footwear according to claim 18, wherein the item of footwear comprises a third magnetic material part and the accessory comprises a third magnetic material part and the first, second and third magnetic material parts of the item of footwear positionally correspond with, respectively, the first, second and third magnetic material parts of the accessory.

20. A footwear kit comprising:

an item of footwear arranged to receive an accessory item which can be manually attached and removed, the item of footwear comprising an upper foot retaining part, and a first magnetic material part and a second magnetic material part, both arranged on the upper foot retaining part, in a way that the upper foot retaining part alone connects and spaces the first and second magnetic material parts, in which the first magnetic material part and the second magnetic material part are arranged in an asymmetric configuration wherein the asymmetric configuration comprises an asymmetric configuration of magnet polarities; and, an accessory item for temporary manual attachment to, and temporary manual removal from, an item of footwear, the accessory item comprising a first magnetic material part and a second magnetic material part, the first magnetic material part and the second magnetic material part are arranged to allow temporary attachment to a magnetic material part on an item of footwear, wherein the first magnetic material part is spaced from the second magnetic material part by a non-magnetic material and the first magnetic material part and the second magnetic material part are arranged in an asymmetric configuration, wherein the asymmetric configuration comprises an asymmetric configuration of magnet polarities.

* * * * *